United States Patent [19]

Ollis et al.

[11] Patent Number: 4,586,776

[45] Date of Patent: May 6, 1986

[54] CABLE TERMINATION ASSEMBLY AND WIRE STRIPPING APPARATUS AND METHOD

[75] Inventors: Frederick R. Ollis, Madison; John N. Tengler, Chardon, both of Ohio

[73] Assignee: Associated Enterprises, Inc., Painesville, Ohio

[21] Appl. No.: 97,036

[22] Filed: Nov. 23, 1979

[51] Int. Cl.[4] ..... H01R 13/58

[52] U.S. Cl. ..... 339/105; 29/858; 339/176 MF; 339/218 M

[58] Field of Search ..... 29/566, 857, 858; 339/17 F, 176 MF, 21 P, 21 R, 21 M, 105.14 R

[56] References Cited

U.S. PATENT DOCUMENTS

| | | | |
|---|---|---|---|
| 3,015,877 | 1/1962 | Francis | 29/858 |
| 3,249,909 | 5/1966 | Kowaleski | 339/105 |
| 3,713,073 | 1/1973 | Narozny | 339/17 F |
| 3,819,848 | 6/1974 | Fry | 174/117 F X |
| 3,963,319 | 6/1976 | Schumacher et al. | 339/17 F X |
| 4,130,934 | 12/1978 | Asick et al. | 339/14 R X |
| 4,310,208 | 1/1982 | Webster et al. | 339/17 F X |

*Primary Examiner*—Eugene F. Desmond

*Attorney, Agent, or Firm*—Renner, Otto, Boisselle & Lyon

[57] ABSTRACT

A cable termination assembly has a staggered stripped cable insulation pattern to enhance the electrical isolation of plural ground isolation conductors from one or more signal conductors in the assembly, and a stepped crimp pattern at a juncture of the cable with a molded strain relief body provides an improved strain relief interaction therebetween. The cable termination assembly is made by removing the cable insulation in a pattern that exposes plural conductors while leaving an insulation portion covering part of one of the conductors to insulate the latter from the other conductors, and the exposed conductors are coupled to electrical contacts while the insulation portion left behind helps to assure the electrical isolation of the conductors from each other. The cable insulation is deformed to cause relatively raised and recessed portions in the same and a strain relief body is molded directly to the insulation with at least a portion of the molded strain relief substantially filling the space within at least one of the recessed portions. A machine prepares the cable for use in the cable termination assembly by partially removing insulation from such cable in a predetermined pattern and crimping the cable.

38 Claims, 20 Drawing Figures

CABLE TERMINATION ASSEMBLY AND WIRE STRIPPING APPARATUS AND METHOD

BACKGROUND OF THE INVENTION

The present invention relates generally to a cable termination assembly, a wire stripping apparatus to facilitate making such assembly and a method of making such assembly.

As is described in detail below, the cable termination assembly preferably is of the type in which plural conductors of a cable are terminated for electrical connection to another device, and typically such cable is of the flat type including, for example, three conductors in planar spaced apart relation in the cable insulation with the center conductor ordinarily carrying electrical signal information and the peripheral conductors providing ground signal isolation. However, although the following description will be directed primarily to the preferred embodiment and best mode of the invention in which the cable termination assembly is for a three conductor flat cable, it will be appreciated that the features of the invention may be employed in connection with other types of cable termination assemblies having more or fewer conductors in flat or other cable.

A cable termination assembly is a device for terminating a cable to provide electrical connection of the cable conductors to another device, such as another cable termination assembly, a terminal strip or board, etc. Such a cable termination assembly conventionally includes the cable, electrical contacts for connection with the cable conductors, and a strain relief mechanism. The contacts may be of the male or female type and usually in the latter case the assembly includes an electrically nonconductive cover or housing for guiding male pin contacts into engagement with respective female contacts in the assembly.

In prior cable termination assemblies for three conductor cables one conductor may carry signal information and the other two conductors may provide ground signal isolation.

It is the norm for cable termination assemblies to include a strain relief mechanism to prevent application of force to connections between conductor wires and electrical contacts in the assembly primarily when the assembly is removed from connection with another device. One type of known strain relief mechanism is that in which a strain relief body is molded directly to the cable to form a substantially integral structure therewith while also preferably providing a hermetic seal about connections between the conductors and contacts, thereby helping to optimize the integrity of such electrical connections while also minimizing any chemical activity at such connections, especially when the electrically conductive materials are dissimilar.

Automated and semi-automated machines for stripping the insulation from conductors of a cable are known in the art. Typically, such machines uniformly strip the insulation from the end of a cable and fully remove the stripped insulation section completely exposing ends of the cable conductors for subsequent connection.

SUMMARY OF THE INVENTION

The fundamental features of the cable termination assembly in accordance with the present invention include the use of a staggered stripped cable insulation pattern to enhance the electrical isolation of the plural conductors in the assembly and in particular the preventing of short circuits between signal and ground conductors, and a stepped crimp pattern at a juncture of the cable with a molded strain relief body providing an improved strain relief interaction therebetween. Moreover, according to the method of the invention, a cable termination assembly is made by removing the cable insulation in a pattern that exposes plural conductors, usually the ground conductors, while leaving an insulation portion covering part of one of the conductors, usually the signal conductor, to insulate the latter from the other conductors, and the exposed conductors are coupled to electrical contacts while the insulation portion left behind helps to assure the electrical isolation of the conductors from each other. The method also includes deforming the cable insulation to cause relatively raised and recessed portions in the same and the molding of a strain relief body directly to the insulation with at least a portion of the molded strain relief substantially filling the space within at least one of the recessed portions. According to the invention a machine also is provided for preparing a cable for use in a cable termination assembly by partially removing insulation from such cable. Such machine preferably includes a slitter for slitting the insulation in a predetermined pattern, thus removing more insulation from one conductor and less insulation from another. The machine also may include a deforming means for crimping the cable and/or a puller means for pulling the cable a predetermined distance while an outlined insulation tab slit from the end of the cable is securely held.

With the foregoing in mind a principal object of the invention is to provide a cable termination assembly improved in the noted respects.

Another principal object is to provide an improved method for making a cable termination assembly.

An additional principal object is to provide an improved machine for preparing a cable for use in a cable termination assembly.

A further object is to minimize the space and materials requirement for a cable termination assembly in which plural cable conductors normally are maintained at the same signal level.

Still another object is to use an insulation finger at the stripped end of a cable for insulating conductors thereat.

Still an additional object is to use crimped raised and recessed portions of a cable as a means for centering the cable in a molding machine to assure substantial cable centering within a directly molded strain relief body.

Still a further object is to provide an improved strain relief for a cable termination assembly.

Even another object is to facilitate the making of a cable termination assembly and preferably to effect the same while assuring the integrity of electrical connections in the assembly.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
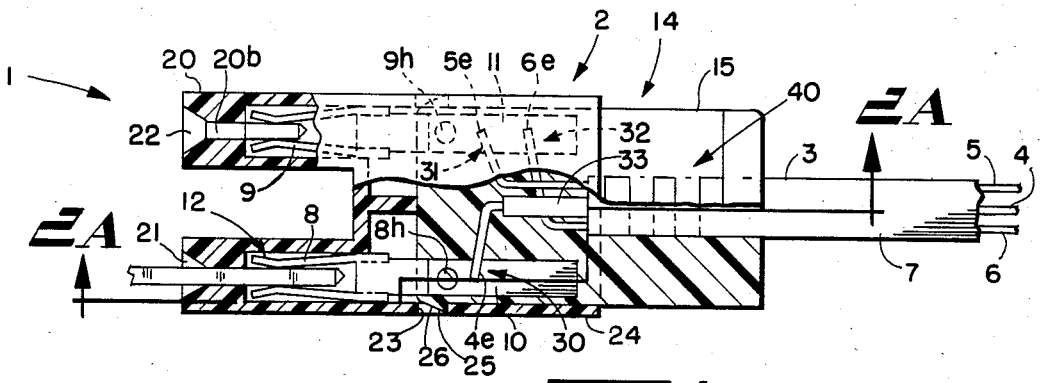
FIG. 1 is a top plan view, partly broken away in section, of a cable termination assembly in accordance with the invention.

Referring now in detail to the drawings, wherein like reference numerals designate like parts in the several figures, and initially to FIGS. 1–5, a cable termination assembly in accordance with the present invention is generally indicated at 1. Such assembly 1 includes a cable termination 2 which is attached to the end of a cable 3. The cable 3 preferably is of the flat, multiconductor type and in the preferred embodiment includes three conductors 4–6 running parallel to each other along the general directional extent of the cable while separated from each other by conventional electrical insulation 7. Preferably the conductor 4 is used to carry electrical signals, such as digital signals or the like, and will be referred to hereinafter as the signal conductor, and the conductors 5, 6 provide ground, or other reference potential, signal isolation for the signal conductor and will be referred to hereinafter as the ground conductors. However, the cable may be other than flat and may include more or fewer than three conductors. The cable termination 2 includes plural electrical contacts, preferably two of them, 8, 9, having flat ends 10, 11 for connection with respective exposed ends 4*e*–6*e* of the cable conductors and connection ends 12, 13 for electrically connecting with another device, such as pin contacts or the like. The termination 2 also includes a strain relief 14, preferably formed by a strain relief body 15 molded directly to the cable 3, as shown, to form an integral structure with the latter while also preferably providing an airtight covering for the spot welded, soldered, or like connections between the exposed conductor ends 4*e*–6*e* and the contact ends 10, 11. Locking holes 8*h*, 9*h* in the contacts 8, 9 fill with material of the strain relief body 15 during molding of the latter securely to lock the contacts in the molded strain relief body.

Figure 3:
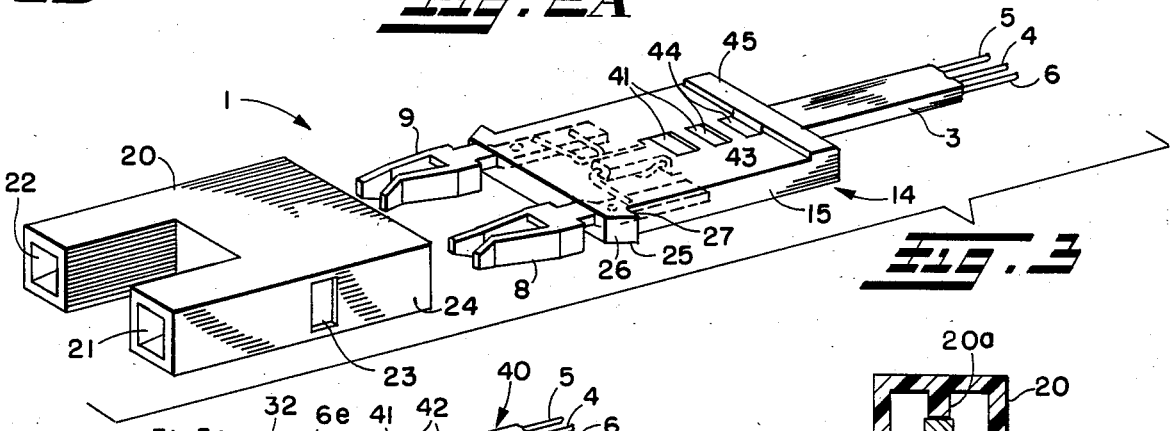
FIG. 3 is an exploded isometric view of the cable termination assembly of FIG. 1.

An electrically nonconductive cover or housing 20 may be slipped over the female contacts 8, 9 to guide male contacts through openings 21, 22 into engagement with such contacts. The housing 20 has a locking opening 23 in an edge wall 24 to receive a locking ramp 25, which is molded as part of the strain relief body 15. As seen in FIGS. 1 and 3, the sloped surface 26 of the locking ramp permits the strain relief body 15 to be inserted into the housing 20, and the stepped surface 27 cooperates with the housing wall at the locking opening 23 normally to prevent removal of the strain relief body from the housing.

Figure 2A:
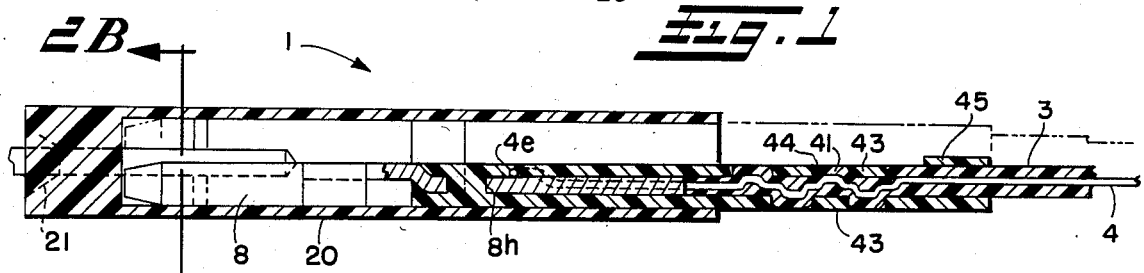
FIG. 2A is a side section view looking generally in the direction of the arrows 2A—2A of FIG. 1.
Figure 2B:
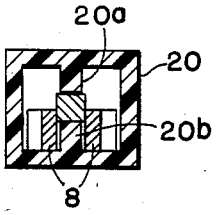
FIG. 2B is a partial section view looking generally in the direction of the arrows 2B—2B of FIG. 2A.

As is illustrated in FIGS. 2A, 2B and 3, the strain relief body 15 and the contacts 8, 9 at their connection ends 12, 13 have about the same thickness, i.e. looking vertically in FIG. 2A, which preferably is about half the total vertical clearance thickness provided for the same inside the housing 20. Therefore two terminating sets including contacts 8, 9 and a strain relief body 15 can be inserted in daisy chain fashion into a common housing as is seen particularly by the additional terminating set shown in phantom lines in FIG. 2A. The contacts 8, 9 are of the female type and preload bars 20*a*, 20*b* in the housing 20 preload the contact tines slightly further open or apart than their normal unloaded relative positions with the frictional forces between the tines and bars tending to help to hold the contacts and strain relief body in relatively fixed position. The bars 20*a*, 20*b* also provide a guiding and centering function for the pin contacts inserted into the housing to engage parts of the tines of one or two (if there are two terminating sets) contacts in the manner illustrated in FIG. 2B.

The signal conductor 4 is attached at a spot welded junction 30 to the contact 8, and both ground conductors 5, 6 are attached at spot welded junctions 31, 32 to the contact 9. Since the ground conductors 5, 6 are on opposite sides of the signal conductor 4 over the major extent of the cable 3 in order to provide effective ground isolation therefor, it is necessary for the signal conductor and one of the ground conductors to cross at the cable termination assembly 1. In particular, the exposed end 6e of ground conductor 6 crosses under the signal conductor 4. In accordance with the invention, an insulation finger 33 about part of the signal conductor 4 proximate its exposed end 4*e* assures effective electrical isolation between the crossing ground conductor exposed end 6*e* and the signal conductor.

Figure 4:
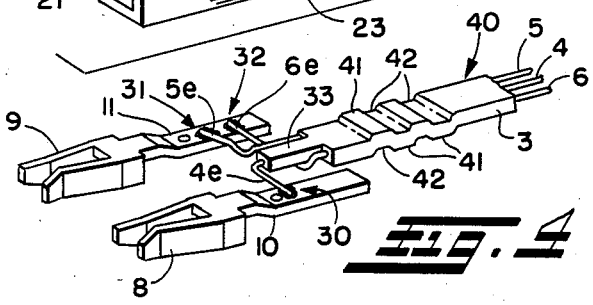
FIG. 4 is a fragmentary isometric view of the connected cable and contacts of the cable termination assembly.

A novel strain relief 14 is an important feature of the invention. Near the exposed conductor ends 4*e*–6*e*, the cable 3 is deformed or crimped to form therein several relatively raised and relatively recessed portions in a wave-like pattern 40, which is best seen in FIG. 4, flowing in the same direction as the cable; the raised cable portions 41 and the recessed portions 42, then, extend in a direction generally transverse to the directional extent of that portion of the cable in which they are formed. Preferably the patterns of raised and recessed portions on the opposite surfaces of the flat cable 3 are of opposite phase, i.e. there is a recessed portion 42 on the opposite side or surface of the cable 3 from a raised portion 41, and vice versa. The relatively raised and recessed cable portions provide a plurality of functions, as follows. During molding of the strain relief body 15 to the insulation 7, the raised portions 41 on both sides of the cable may engage opposite surfaces of the mold appropriately to locate or to center the cable in the mold and in the subsequently molded thereabout strain relief body 15. Otherwise, the cable may become positioned too close to one of the strain relief body surfaces during the molding process such that in the end product the cable could too easily be peeled from the strain relief body. Thus, the strain relief body 15 in the present invention may be relatively thin minimizing material and space requirements, while securely holding the cable 3 therein. Also, the recessed portions 42 provide a volume for receiving a quantity of the molding material during molding of the strain relief body 15 so that such molding material in effect forms a plurality of locking bars 43 located in such recesses securely holding the cable in the strain relief body. Moreover, the relatively raised portions 41 form insulation bars with surfaces 44 which directly confront or abut respective edges of the locking ribs or bars 43. The insulation surfaces 44 and the abutting edges of the locking bars 43 cooperate to transfer forces therebetween such that the area at which such forces are transferred has a substantial vector component extent that is generally perpendicular to the force direction thereby to provide high integrity to the mechanical interconnection between the cable and strain relief body even in the presence of relatively large forces applied in the major direction of the cable tending to separate the latter and the strain relief body. The recessed portions 42 further assure that material of the strain relief body 15 will pass across the cable 3 at both major surfaces thereof, and at the back end of the strain relief body 15 a relatively thick bar-like portion 45 (FIG. 3) may be molded as part of such body to maximize the amount of material surrounding the cable thereby to assure full coverage of the latter where it enters the strain relief body to prevent the possibility of a starting point there for a peeling separation between the cable and body.

Briefly, in accordance with the method of the present invention for making the cable termination assembly 1, the cable 3 is prepared; the exposed cable conductor ends are connected to the contacts; the strain relief body is molded about the cable and the junctions of the exposed conductor ends and contacts; and the housing 20, if used, is slipped over the contacts and strain relief body.

Figure 5A:
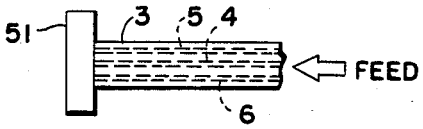
FIGS. 5A–5D are schematic illustrations of a method for preparing the cable for use in the cable termination assembly.
Figure 5C:
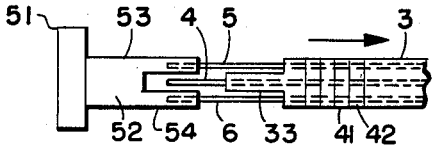
Figure 5B:
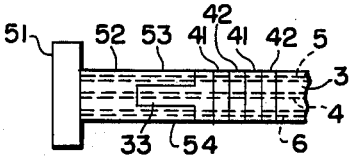

To prepare the cable it is necessary to strip insulation to expose the conductor ends, to crimp the cable or otherwise to deform the same to obtain the raised and recessed portions 41, 42 mentioned above, and to cross one of the ground and signal conductors. The steps for effecting such preparation are schematically illustrated in FIGS. 5A–5D. The steps illustrated in FIGS. 5A–5C may be carried out according to the machine operating steps schematically depicted in FIGS. 6A–6D utilizing the wire stripping apparatus 50, which is described in detail below. The cable 3 is fed into the apparatus 50 a predetermined distance established by an end stop wall 51 or is otherwise supplied ready for stripping, as is shown in FIG. 5A. In FIG. 5B the cable insulation 7 is slit according to a prescribed pattern preferably leaving an insulation finger 33 extending over the signal conductor 4 a longer distance than the insulation left remaining over the ground conductors 5, 6; the boundaries of a U-shape insulation tab 52 are accordingly established. The cable 3 also is deformed by crimping the same to establish the relatively raised and recessed portions 41, 42. Turning to FIG. 5C, relative movement is effected between the tab 52 and the major extent of the cable 3 thereby to draw the ends of the conductors into the tab. Preferably such relative movement between the tab 52 and cable 3 is adequate to draw the signal conductor fully out from the tab leaving the conductor end **4*e* fully exposed while the ends 5*e*, 6*e* of the ground conductors remain within covering finger portions 53, 54** of the tab.

Figure 5D:
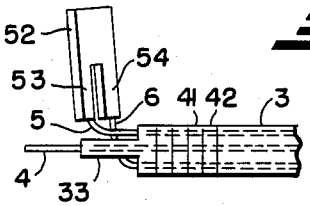

The insulation tab 52 is used to facilitate manipulation of the ground conductors to cross the exposed ground conductor end **6*e* under the exposed signal conductor end 4*e*. For that purpose, as is shown in FIG. 5D, the insulation tab 52 is rotated about 180° about an axis established by the ground conductor 5 such that the covering finger portion 54 passes into the plane of the drawing (relative to FIG. 5C); and at the same time the tab 52 is bent or twisted slightly to bend the ground conductor ends 5*e*, 6*e* to an offset position ready for attachment to the electrical contact. The ground conductor end 6*e* remains insulated from the signal conductor 4 by the insulation finger 33. Finally, the insulation tab 52 is removed from the ground conductor ends 5*e*, 6*e*, the signal conductor end 4*e* is bent into position for attachment to the electrical contact 8, and the junctions 30–32** with such contacts are made.

Although the aforesaid manipulation of the ground conductors may be effected manually without the facilitating use of the insulation tab 52, it will be appreciated that such manual manipulation would require more time and skill than the described operation. Additionally, although the insulation may be stripped without leaving the insulation finger 33 covering the signal conductor 4, it will be appreciated that such insulation finger assures electrical isolation between the signal conductor and the relatively crossed over (or under) ground conductor.

To prepare the cable 3 according to the steps illustrated in FIGS. 5A–5C, the wire stripping apparatus 50 includes a pair of relatively movable members or slitter blocks 60, 61 and a pair of relatively movable members or crimping blocks 62, 63, shown in FIGS. 6A–6D. In the preferred embodiment the lower block 61, 63 are fixed in the apparatus 50 and the upper blocks 60, 62 are movable vertically. Additionally, the crimping blocks 62, 63 are movable laterally or arcuately to effect lateral pulling of the cable 3 while the slitter blocks 60, 61 hold the tab 52 therein.

Figure 6A:
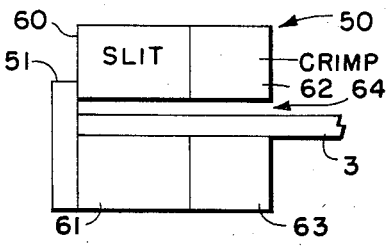
FIGS. 6A–6D are schematic illustrations of a machine in accordance with the invention and its manner of use for preparing the cable for use in a cable termination assembly.
Figure 6B:
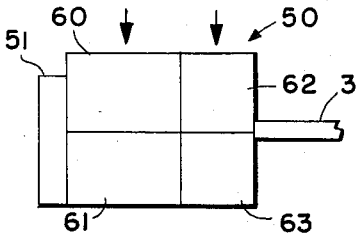
Figure 6C:
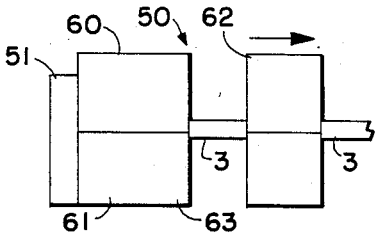
Figure 6D:
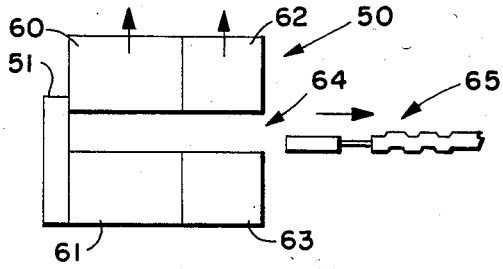

Looking at FIG. 6A the cable 3 is inserted into the space 64 between the upper and lower blocks to engage the end stop wall 51. Thereafter, both sets of blocks are closed, as is shown in FIG. 6B; at this time the slitter blocks 60, 61 slit the cable insulation accurately according to the desired pattern shown in FIG. 5B preferably without nicking the conductors and the crimping blocks 62, 63 crimp the raised and recessed wave pattern 40 into the cable. In FIG. 6C the crimping blocks are moved laterally while still securely holding the cable 3 therebetween and while the slitter blocks remain closed to hold the insulation tab 52 therein, thereby to pull the cable 3 away from the tab drawing the conductors into the latter a distance shown in FIG. 5C (the end 4*e* being exposed from the tab and the ends 5*e*, 6*e* remaining in the finger portions 53, 54). Finally, the slitter and crimping blocks are parted vertically and the prepared cable generally indicated at 65 in FIG. 6D is removed therefrom; also, the parted crimping blocks 62, 63 are returned laterally or arcuately to the position shown in FIG. 6D ready to prepare the next cable.

Turning now to FIGS. 7–13, the wire stripping apparatus or machine 50 is illustrated in greater detail. It has been discovered that to effect a clean slitting operation without ripping or tearing the insulation and without damaging the conductors of the cable 3, it is desirable that the several slitter blades of the slitter blocks be formed by the intersection of two surfaces, one of which is approximately vertical and the other of which intersects the latter at an angle of approximately 45°. Other angular relationships also may be used, if desired, keeping in mind, however, that slitting preferably should occur a maximum amount through the insulation while a fairly maximum support function is provided the cable and the slitter blades are ordinarily not permitted to nick or otherside to touch the conductors in the cable.

Figure 7:
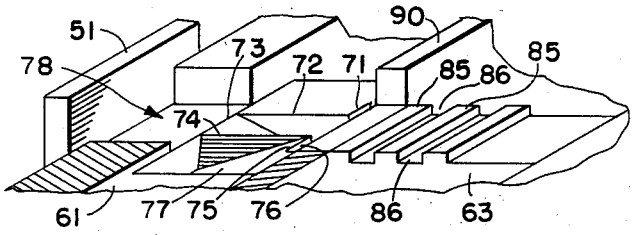
FIG. 7 is an isometric view, partly broken away in section, of the lower slitter block and crimping block of the machine in accordance with the invention, it being appreciated that the upper slitter and crimping blocks are of similar character.

Referring briefly to FIG. 7, the lower slitter block 61 includes five slitter blades 71–75, each being formed by a substantially vertical surface, such as surface 76 of slitter blade 75, and an angularly declining surface, such as the surface 77 associated with the slitter blade 75. The surfaces 76, 77 preferably meet along the line of the slitter blade 75 defining a cutting edge at an acute angle of approximately 45° therebetween. The slitter block 61 also includes a guide space 78 for guiding the cable 3 directly to abutting engagement with the end stop wall 51 and for guiding movement of the upper slitter block 60 with respect to the lower slitter block 61; the upper slitter block 60 accordingly has a downwardly extending guide tab, not shown, that fits closely in the guide space 78 for vertical movement therein. The upper slitter block 60 also has five slitter blades aligned directly above the slitter blades 71–75 of the lower slitter block 61.

Figure 12:
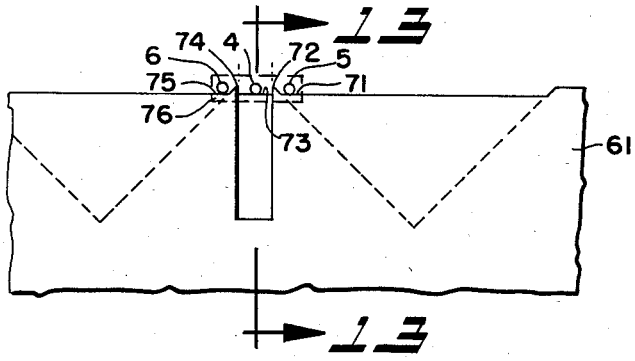
FIG. 12 is a front end view of the lower slitter block looking generally in the direction of the arrows 12—12 of FIG. 11.

The longitudinal slitter blades 72, 74, longitudinal meaning that they extend longitudinally parallel to the major directional extent of the cable and conductors, terminate in a common plane with each other and are intended to abut or nearly to abut the corresponding longitudinal slitter blades in the upper slitter block 60 when the two slitter blocks 60, 61 are closed to a maximum position. As is seen in FIG. 12 the longitudinal slitter blades 72, 74 of the lower slitter block 61 pass or slit about halfway through the cable 3 as do the longitudinal slitter blades of the upper slitter block 60. However, the plane in which the transverse slitter blades 71, 73, 75 of both the lower and upper slitter blocks 60, 61, transverse meaning that such slitter blades extend in a direction approximately transverse to the directional extend of the cable, is lower than or recessed relative to that in which the longitudinal slitter blades 72, 74 terminate so that such transverse slitter blades will slit only partly, i.e. less than halfway, through the insulation 7 without nicking the conductors therein.

Figure 10:
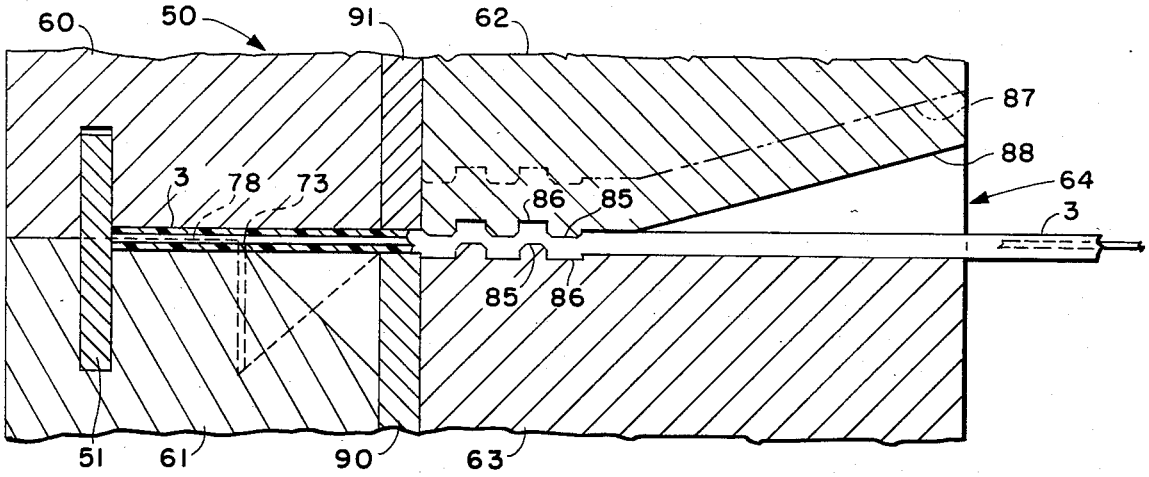
FIG. 10 is an enlarged fragmentary view of the machine illustrating the slitter and crimping blocks.
Figure 11:
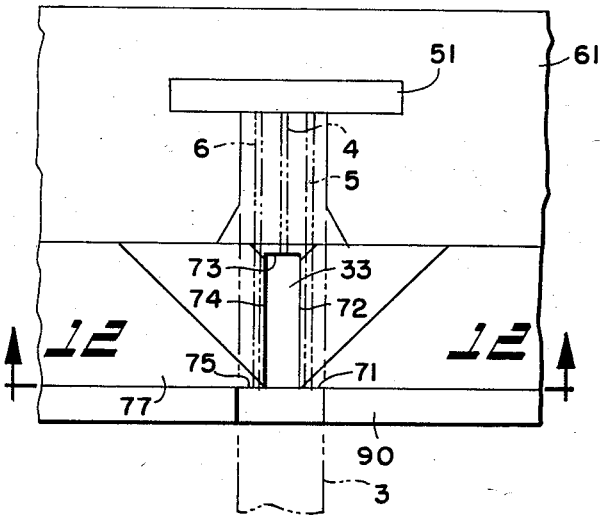
FIG. 11 is an enlarged plan view looking down on the top of the lower slitter block.
Figure 13:
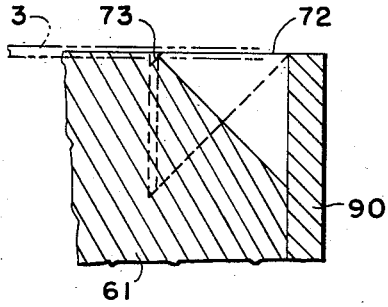
FIG. 13 is a section view of the lower slitter block looking generally in the direction of the arrows 13—13 of FIG. 12.

The crimping blocks 62, 63 have a plurality of crimping steps and recesses 85, 86 that mate with each other approximately to the closed position shown in solid line in FIG. 10 to crimp the cable 3 therebetween. With the upper crimping block 62 raised in the wire stripping apparatus 50 to the position shown at the phantom line 87 in FIG. 10, and the slitter block 60 also raised a similar amount, a tapered opening 88 guides the cable 3 into properly aligned position in the apparatus 50 to abutment with the end stop wall 51. The crimping blocks 62, 63 also have a wire guide wall 90, 91, which may be integral with or a separate part from the respective crimping blocks to guide the cable into proper alignment in the slitter blocks.

Figure 8:
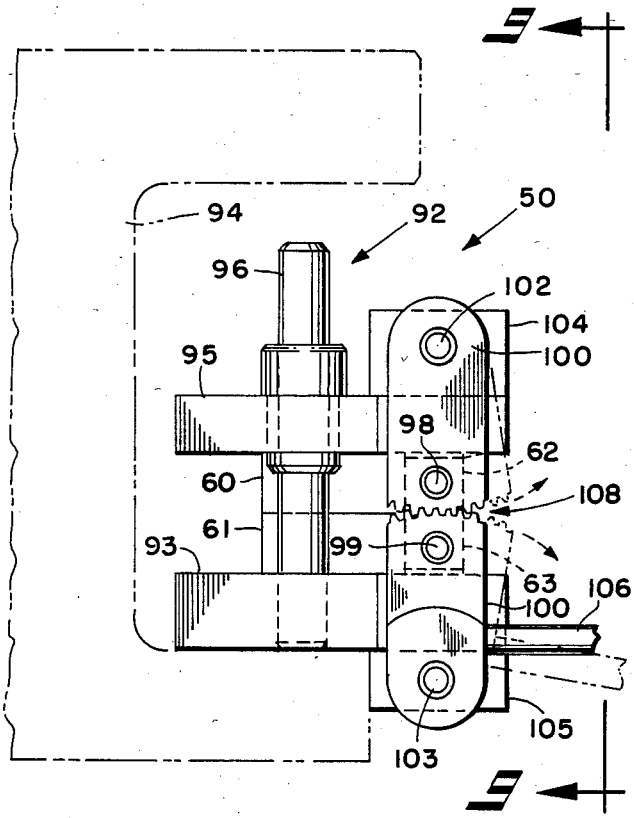
FIG. 8 is a side elevation view of an arbor press machine in accordance with the invention employing the slitter and crimping blocks of FIGS. 6A–6D and 7 for preparing a cable for use in a cable termination assembly.
Figure 9:
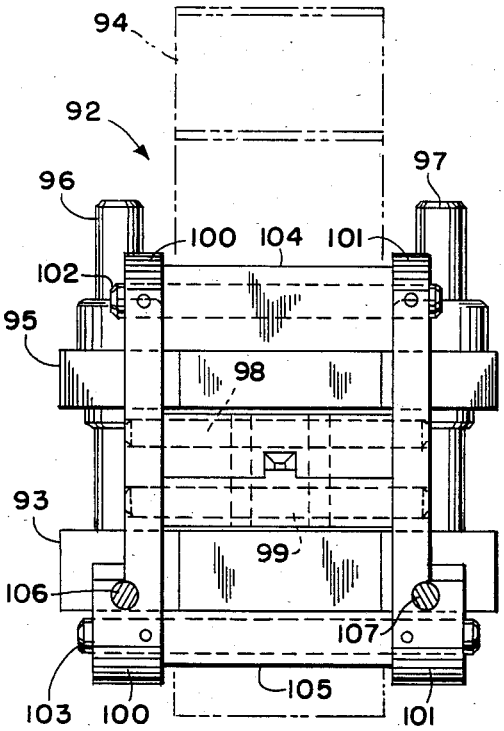
FIG. 9 is a front elevation view of the machine looking generally in the direction of the arrows 9—9 of FIG. 8.

Referring to FIGS. 8 and 9, the slitter and crimping blocks 60–63 are mounted in an arbor press 92. The lower slitter block 61 is relatively fixedly mounted in a base 93, which is in turn attached to the frame 94 of the arbor press. The upper slitter block 60 is mounted in a base 95, which is movable vertically on a pair of posts 96, 97 fixed in the base 93 in conventional manner. The crimping blocks 62, 63 are pivotally mounted by pins 98, 99 in geared arms 100, 101 preferably at both sides of the apparatus 50, and the geared arms are mounted, respectively, by pins 102, 103 in extension portions 104, 105 attached to the respective bases. A pair of handles 106, 107 extend outwardly from the arms 100, 101, and a return spring, not shown, preferably normally urges the arms 100, 101 and the handles to the positions shown in solid lines in FIGS. 8 and 9 such that the crimping blocks 62, 63 are in abutment with the respective slitter blocks 60, 61 in the manner shown, for example, in FIG. 10. However, by applying a downward force on the handles 106, 107, the geared arms 100, 101 linked by their coupling gears generally designated at 108 rotate in a righthand direction relative to the illustration of FIG. 8 to move the crimping blocks 62, 63 also in a righthand direction thus pulling the cable to the right relative to the slitter blocks 60, 61 while the latter securely hold the insulation tab 52 therein. Also, a conventional handle operating mechanism, not shown, may be selectively operated to close the press 92 urging the base 95 toward the base 92 bringing the upper slitter and crimping blocks toward the lower ones, preferably with the longitudinal slitter blades of the upper and lower slitter blocks engaging each other, to slit and to crimp the cable 3 as was described above.

In view of the foregoing, it will be appreciated that the wire stripping apparatus 50 may be used to prepare a cable 3 for use in a cable termination assembly and the cable termination assembly may be used for electrical signal coupling purposes.

We claim:

1. A cable termination assembly, comprising a cable, including plural conductors and insulation covering at least a portion of said conductors, electrical connection means for electrically connecting said conductors to another device, each of said conductors having a conductor portion exposed beyond said insulation at an end of said cable for connection with said electrical connecting means, and said insulation including an insulation portion means covering part of one of said conductors for insulating said one conductor from the exposed conductor portion of another of said conductors, and wherein the exposed conductor portion of said another conductor is positioned to cross the directional extent of said one conductor at an area of the latter that is located within said insulation portion, and wherein said insulation portion electrically separates said one and said another conductors from each other, said cable comprising a flat cable having at least three conductors extending in approximately parallel directions at spaced apart positions at least approximately in a common plane in said insulation, said electrical connecting means comprising at least two of the same, means for coupling one conductor positioned between the other two conductors to one electrical connecting means and means for coupling said other two conductors to another common electrical connecting means, and wherein said electrical connecting means includes electrical contacts extending in a direction at least approximately parallel to the major directional extent of said cable, and further comprising strain relief means molded directly to said insulation and covering junctures of said exposed conductor portions and electrical connecting means to form a substantially integral structure therewith for providing strain relief for the cable termination assembly.

2. The assembly of claim 1, further comprising crimp-like means in said insulation for cooperating with said strain relief means to hold said strain relief means and said insulation securely as an integral assembly.

3. The assembly of claim 1, said insulation having transverse recess means therein for receiving part of said strain relief means, and said strain relief means having a part extending into said transverse recess means.

4. The assembly of claim 1, said electrical connecting means including hole means therethrough for receiving material of said strain relief means to lock the same together as an integral structure.

5. The assembly of claim 1, further comprising housing means for covering at least part of said electrical connecting means, said housing means having opening means for guiding further electrical connecting means into electrical connection with respective electrical connecting means in said housing.

6. The assembly of claim 5, said strain relief means including a locking ramp, and said housing means including opening means for cooperating with said locking ramp to lock said housing means and said strain relief means in fixed relative position.

7. A cable termination assembly, comprising a cable, including at least one conductor and insulation covering at least a portion of said conductor, electrical connecting means for electrically connecting said conductor to another device, strain relief means molded directly to said insulation to form a substantially integral structure therewith for providing strain relief for the cable termination assembly, and crimp-like means in said insulation for cooperating with said strain relief means to hold said strain relief means and said insulation securely as an integral assembly, said strain relief means comprising a strain relief body molded in position about at least part of said crimp-like means, said crimp-like means comprising substantially straight recessed and raised portions substantially permanently formed in and across at least one surface of said insulation at least approximately transverse to the major axis of said cable thereat, and said strain relief means including a molded strain relief portion in said recessed portion of said insulation to form a locking bar thereacross holding said insulation in said strain relief means.

8. The assembly of claim 7, said cable comprising flat cable, said crimp-like means comprising raised and recessed portions in both surfaces of said cable in opposite phase with each other, and said strain relief means including a locking bar in and across at least one recessed portion on each surface of said cable.

9. The assembly of claims 7 or 8, said strain relief means including locking bars on both sides of at least one raised portion of said insulation, and said raised portion of said insulation including at least an exposed surface portion exposed in the surface of said strain relief means.

10. The assembly of claim 9, said strain relief means including a relatively thick portion proximate the edge thereof that said cable enters the same.

11. The assembly of claims 7 or 8, said at least one conductor comprising plural conductors in said cable, said electrical connecting means comprising plural electrical connecting means, each of said conductors having a conductor portion exposed beyond said insulation at an end of said cable for connection with said electrical connecting means, and said insulation including an insulation portion means covering part of one of said conductors for insulating said one conductor from the exposed conductor portion of another of said conductors.

12. The assembly of claim 11, said strain relief means comprising a strain relief body molded over junctures of said exposed conductor portions and electrical connecting means.

13. A cable termination assembly, comprising a cable, including at least one conductor and insulation covering at least a portion of said conductor, electrical connecting means for electrically connecting said conductor to another device, strain relief means molded directly to said insulation to form a substantially integral structure therewith for providing strain relief for the cable termination assembly, and said insulation having a plurality of transverse recess means substantially permanently formed therein for receiving part of said strain relief means, and said strain relief means having a part extending into said transverse recess means, said strain relief means comprising a strain relief body molded directly about at least part of said transverse recess means.

14. The assembly of claim 13, said transverse recess means comprising plural transverse recess means in and across at least one surface of said insulation at least approximately transverse to the major directional extent thereof, further comprising a raised insulation portion between respective relatively adjacent transverse recess means, and said part of said strain relief means extending into said transverse recess means forming a locking bar across said insulation holding said insulation in said strain relief means.

15. The assembly of claim 14, said cable comprising flat cable, said transverse recess means comprising a plurality of transverse recess means separated by respective raised portions of said insulation in both surfaces of said cable and in opposite phase with respect to each other on such opposite surfaces, and said strain relief means including a locking bar in and across at least one recessed portion on each surface of said cable.

16. The assembly of claims 14 or 15, said strain relief means including locking bars on both sides of at least one raised portion of said insulation and said raised portion of said insulation including at least an exposed surface portion exposed in the surface of said strain relief means.

17. The assembly of claim 16, said strain relief means including a relatively thick portion proximate the edge thereof that said cable enters the same.

18. The assembly of claims 13, 14, or 15, said at least one conductor comprising a plurality of conductors in said cable, said electrical connecting means comprising a plurality of electrical connecting means, each of said conductors having a conductor portion exposed beyond said insulation at an end of said cable for connection with said electrical connecting means, and said insulation including an insulation portion means covering part of one of said conductors for insulating said one conductor from the exposed conductor portion of another of said conductors.

19. The assembly of claim 18, wherein each of said conductors is completely exposed at the end of said cable, and said insulation portion means extends a distance along said part of one of said conductors remaining integrally connected with the major extent of said cable insulation.

20. The assembly of claim 18, wherein the insulation of said cable defines a plane, and said another conductor crosses said one conductor while passing in a direction substantially parallel with such plane of said cable.

21. The assembly of claim 18, said strain relief means comprising a molded strain relief body covering the junctures of said exposed conductor portions and said electrical connecting means.

22. The assembly of claim 21, wherein the insulation of said cable defines a plane, and said another conductor crosses said one conductor while passing in a direction substantially parallel with such plane of said cable.

23. A method for making a cable termination assembly, including a cable having plural conductors and insulation, and electrical connecting means for connecting such conductors to another device, comprising removing insulation from an end of such cable to expose plural conductors while leaving an insulation portion covering part of one of such conductors to insulate the same from the exposed conductor portion of another of such conductors, positioning at least one of said exposed plural conductors across the insulation portion covering part of the one of such conductors, and coupling such exposed conductors to such electrical connecting means while such insulation portion insulates such one and another conductors, said removing comprising partially removing insulation from an end part of one conductor and fully removing insulation from an end part of one conductor, said coupling including manipulating one conductor with respect to another conductor for coupling the same to electrical connecting means, said fully removing comprising fully removing insulation from an end of such one conductor covered by such insulation portion, and said manipulating comprising manipulating such partially removed insulation thereby to bend at least one conductor remaining partly therein with respect to such one conductor covered by such insulation portion.

24. The method of claim 23, such cable comprising a flat cable with at least three generally parallel extending conductors, said removing comprising fully removing insulation from an end of a middle one of such conductors and said partially removing comprising partially removing insulation from the peripheral conductors while leaving end parts thereof still within such insulation, and said manipulating comprising twisting such partially removed insulation to bend one of such peripheral conductors across the directional extent of such middle conductor while such insulation portion covering such middle conductor insulates the latter relative to such crossed over peripheral conductor.

25. The method of claim 24, said coupling comprising attaching such middle conductor to one electrical contact and such peripheral conductors to a further common electrical contact.

26. The method of claim 23, said removing comprising stripping a length of insulation from at least some of such conductors and a relatively shorter length of insulation from at least one other conductor, thereby leaving such insulation portion covering part of such at least one other conductor.

27. The method of claim 23, said removing comprising slitting a U-shape insulation tab in such insulation leaving such insulation portion extending between the legs of such tab, and pulling such tab fully to expose the end of at least one conductor in such insulation portion and partly to withdraw the ends of at least one conductor in each leg into such respective legs.

28. The method of claim 23, said coupling comprising attaching such conductors to respective electrical contacts.

29. The method of claim 23, further comprising deforming such insulation to cause relatively raised and recessed portions in the same.

30. The method of claim 29, such cable comprising flat cable having plural conductors therein, and said deforming comprising crimping such cable to form plural out of phase recessed and raised portions on both sides thereof.

31. The method of claims 29 and 30, further comprising molding a strain relief means for providing strain relief for the cable termination assembly directly to such insulation with at least a portion of such molded strain relief substantially filling the space within at least one such recessed portion.

32. The method of claims 25, 28 or 29, further comprising molding a strain relief means for providing strain relief for the cable termination assembly directly to such insulation to cover junctions of such conductors and electrical connecting means.

33. The method of claim 32, wherein said molding comprises molding such strain relief means while leaving a portion of such electrical connecting means exposed therefrom, and further comprising covering such exposed ends of such electrical connection means in a manner to provide guidance for insertion of further electrical connecting means to electrical connection therewith.

34. A method for making a cable termination assembly, including a cable having plural conductors and insulation, and electrical connecting means for connecting such conductors to another device, comprising deforming such insulation to cause relatively raised and recessed portions in the same, coupling such conductors to such electrical connecting means, and molding a strain relief means for providing strain relief for the cable termination assembly directly to such insulation with at least a portion of such molded strain relief substantially filling the space within at least one such recessed portion, said molding comprising forming locking bars across a surface of such cable to lock the latter in such strain relief means.

35. The method of claim 34, further comprising prior to such coupling step, removing insulation from an end of such cable to expose plural conductors while leaving an insulation portion covering part of one of such conductors to insulate the same from such exposed conductor portion of another of such conductors, and said coupling comprising coupling such exposed conductors to such electrical connecting means while such insulation portion insulates such one and another conductors.

36. The method of claim 34, such cable comprising flat multiconductor cable, and said deforming comprising crimping such cable to form plural out of phase recessed and raised portions on both sides thereof.

37. The method of claim 34, said molding comprising molding a strain relief means to cover junctions of such conductors and electrical connecting means.

38. The method of claim 34 or 36, said molding comprising placing such cable in a molding machine mold and using such raised portions of such insulation to locate such cable in such mold.

* * * * *